US005256939A

United States Patent [19]

Nilssen

[11] Patent Number: 5,256,939

[45] Date of Patent: Oct. 26, 1993

[54] MAGNETIC ELECTRONIC FLUORESCENT LAMP BALLAST

[76] Inventor: Ole K. Nilssen, Caesar Dr., Rte. 5, Barrington, Ill. 60010

[21] Appl. No.: 853,876

[22] Filed: Mar. 18, 1992

Related U.S. Application Data

[63] Continuation of Ser. No. 515,369, Apr. 30, 1990, abandoned, which is a continuation of Ser. No. 791,057, Oct. 24, 1985, abandoned.

[51] Int. Cl.[5] ..... H05B 41/14

[52] U.S. Cl. ..... 315/244; 315/242; 315/97; 315/DIG. 5

[58] Field of Search ..... 315/97, 102, 103, 105, 315/106, 107, DIG. 2, 242, 247, DIG. 5

[56] References Cited

U.S. PATENT DOCUMENTS

| | | | |
|---|---|---|---|
| 3,710,177 | 6/1973 | Ward | 315/106 |
| 4,184,128 | 1/1980 | Nilssen | 315/DIG. 2 |
| 4,306,177 | 12/1981 | Koneda | 315/106 X |
| 4,399,391 | 8/1983 | Hammer et al. | 315/106 X |
| 4,453,109 | 6/1984 | Stupp et al. | 315/106 X |
| 4,507,698 | 3/1985 | Nilssen | 315/DIG. 7 |

*Primary Examiner*—Robert J. Pascal
*Assistant Examiner*—Ali Neyzari

[57] ABSTRACT

A magnetic-type ballast powers an F40/T12 four foot fluorescent lamp from a regular 120 Volt/60 Hz power line by way of a main inductor. A power factor correction capacitor is connected in series with an auxiliary inductor of relatively small inductance value, thereby forming a series-combination; which series-combination is connected across the power line. A 30 Volt/60 Hz voltage is established across this auxiliary inductor. The phasing of this 30 Volt/60 Hz voltage is opposite that of the 120 Volt/60 Hz power line voltage. Thus, by adding the 30 Volt/αHz voltage to the 120 Volt/60 Hz voltage, a 150 Volt/60 Hz voltage is obtained; which 150 Volt/60 Hz voltage is of magnitude adequate to properly power the F40/T12 four foot fluorescent lamp, although it is not of magnitude adequate to provide proper lamp ignition in a rapid-start mode.

A small inverter-type power supply is used for providing cathode heating power to the lamp's thermionic cathodes as well as for providing lamp ignition voltage by way of a relatively high-magnitude (250 Volt) high-frequency (30 kHz) voltage supplied to the lamp through a high-pass filter and operative to rapid-start the lamp. After the lamp has been rapid-started by this 250 Volt/30 kHz ignition voltage, it is ready to be properly powered by the 150 Volt/60 Hz voltage.

After lamp ignition, power output from the power supply is halted, thereby removing both cathode heating power as well as lamp ignition voltage.

15 Claims, 2 Drawing Sheets

MAGNETIC ELECTRONIC FLUORESCENT LAMP BALLAST

This application is a continuation of Ser. No. 07/515,369 filed Apr. 30, 1990, abandoned, which is a continuation of Ser. No. 06/791,057 filed Oct. 24, 1985, abandoned.

BACKGROUND OF THE INVENTION

1. Field of Invention

The invention relates to high-efficiency magnetic-type ballasts for fluorescent lamps, particularly of a type using electronic means to assist in the ballasting function.

2. Prior Art and General Background

It is well known that significant improvements in luminous efficacy of fluorescent lighting can be attained by way of using high-frequency electronic ballasts, especially in connection with also using special high-efficacy fluorescent lamps.

Used with ordinary F40/T12 four-foot fluorescent lamps, a good quality high-frequency electronic ballast provides for an overall improvement in luminous efficacy of about 25%. Also using high-efficacy lamps can yield an additional 25% improvement—for an overall efficacy improvement of about 44%.

However, the complexity and relatively high cost of high-frequency electronic ballasts constitute a significant impediment against their widespread use, thereby providing an incentive for finding alternative high-efficiency ballasting means.

SUMMARY OF THE INVENTION

Objects of the Invention

A first object of the present invention is that of providing high-efficiency magnetic ballasts for powering fluorescent lamps.

A second object is that of providing in such magnetic ballasts a means by which the heating power for the lamp cathodes can be removed or at least significantly reduced after the fluorescent lamps have ignited.

A third object is that of providing a ballasting means whereby a fluorescent lamp can be rapid-started and properly operated from a voltage of relatively low magnitude.

These as well as other objects, features and advantages of the present invention will become apparent from the following description and claims.

Brief Description

In its preferred embodiment, the present invention constitutes a magnetic reactor-type ballast for powering an F40/T12 four foot fluorescent lamp from a regular 120 Volt/60 Hz power line by way of a main inductor.

A power factor correction capacitor is connected in series with an auxiliary inductor of relatively small inductance value, thereby forming a series-combination; which series-combination is connected across the power line, thereby providing power factor connection.

A 30 Volt/60 Hz voltage is established across the auxiliary inductor. The phasing of this 30 Volt/60 Hz voltage is opposite that of the 120 Volt/60 Hz power line voltage. Thus, by adding the 30 Volt/60 Hz voltage to the 120 Volt/60 Hz voltage, a 150 Volt/60 Hz voltage is obtained; which 150 Volt/60 Hz voltage is of magnitude adequate to properly power the F40/T12 four foot fluorescent lamp, although it is not of magnitude adequate to provide proper lamp ignition in a rapid-start mode.

A small inverter-type high-frequency power supply is used for providing cathode heating power to the lamp's thermionic cathodes as well as for providing lamp ignition voltage by way of a relatively high-magnitude (250 Volt) high-frequency (30 kHz) voltage supplied to the lamp through a high-pass filter and operative to rapid-start the lamp. After the lamp has been rapid-started by this 250 Volt/30 kHz ignition voltage, it is ready to be properly powered by the 150 Volt/60 Hz voltage.

After lamp ignition, in response to 60 Hz current flowing through the main inductor, power output from the high-frequency power supply is halted, thereby removing both cathode heating power as well as lamp ignition voltage.

If 60 Hz current through the main inductor were to cease to flow—as, for instance, would occur if the lamp were to be removed from its sockets—power output from the high-frequency power supply would automatically be resumed.

DESCRIPTION OF THE PREFERRED EMBODIMENT

Details of Construction

Figure 1:
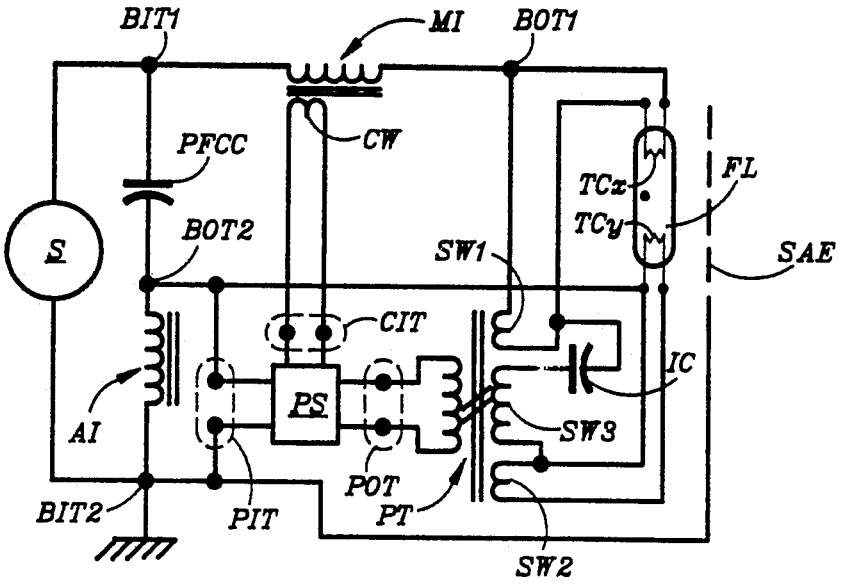
FIG. 1 schematically shows the preferred of the invention—as arranged to power a single fluorescent lamp.

In FIG. 1, a source S of 120 Volt/60 Hz voltage is connected across ballast input terminals BIT1 and BIT-2—with terminal BIT2 being connected with or referenced to ground.

A main inductor MI is connected between ballast input terminal BIT1 and a first ballast output terminal BOT1. This main inductor has a control winding CW.

An auxiliary inductor AI is connected between a second ballast output terminal BOT2 and ballast input terminal BIT2.

A power factor correction capacitor PFCC is connected between ballast input terminal BIT1 and ballast output terminal BOT2.

A fluorescent lamp FL has a first thermionic cathode TCx and a second thermionic cathode TCy, with each cathode having a pair of cathode terminals. One of the terminals of thermionic cathode TCx is connected with ballast output terminal BOT1; and one of the terminals of thermionic cathode TCy is connected with ballast output terminal BOT2.

A starting aid electrode SAE is positioned adjacent the fluorescent lamp and electrically connected with ballast input terminal BIT2.

A high-frequency inverter-type power supply PS has a pair of power input terminals PIT, pair of power output terminals POT, and a pair of control input terminals CIT. Power input terminals PIT are connected across the terminals of auxiliary inductor AI; power output terminals POT of power supply PS are connected across the terminals of a primary winding of a high-frequency power transformer PT; and control input terminals CIT is connected with the terminals of control winding CW.

Power transformer PT has a first secondary winding SW1, a second secondary winding SW2, and a third secondary winding SW3. The terminals of first secondary winding SW1 are connected with the terminals of thermionic cathode TCx; and the terminals of second secondary winding SW2 are connected with the terminals of thermionic cathode TCy. Third secondary winding SW3 is connected in series with an ignition capacitor IC to form a series-combination; and this series-combination is connected between one of the terminals of thermionic cathode TCx and one of the terminals of thermionic cathode TCy.

Figure 2:
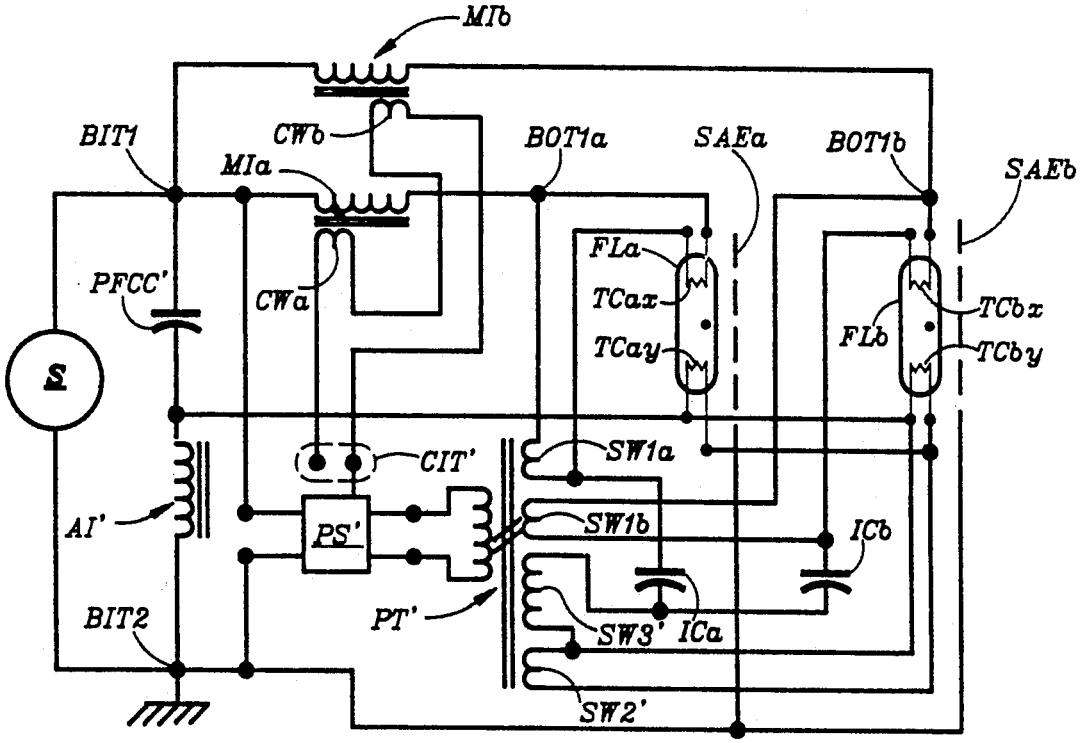
FIG. 2 shows the preferred embodiment as arranged to power two fluorescent lamps in parallel.

FIG. 2 illustrates the arrangement of FIG. 1 adapted to power two fluorescent lamps rather than one.

The arrangement of FIG. 2 has: i) two main inductors MIa and MIb, each with a control winding CWa and CWb, i) two first ballast output terminals BOT1a and BOT1b, iii) two fluorescent lamps FLa and FLb, having thermionic cathodes TCax/TCay and TCbx/TCby, iv) two starting aid electrodes SAEa and SAEb, and v) two ignition capacitors ICa and ICb, all respectively.

Otherwise, arrangement of FIG. 2 comprises: i) a source S of 120 Volt/60 Hz voltage; ii) a power factor correction capacitor PFCC'; iii) an auxiliary inductor AI'; and iv) a power supply PS' connected across ballast input terminals BIT1/BIT2 and coupled with a high-frequency power transformer PT' having four secondary windings, SW1a, SW1b, SW2', and SW3'.

Figure 3:
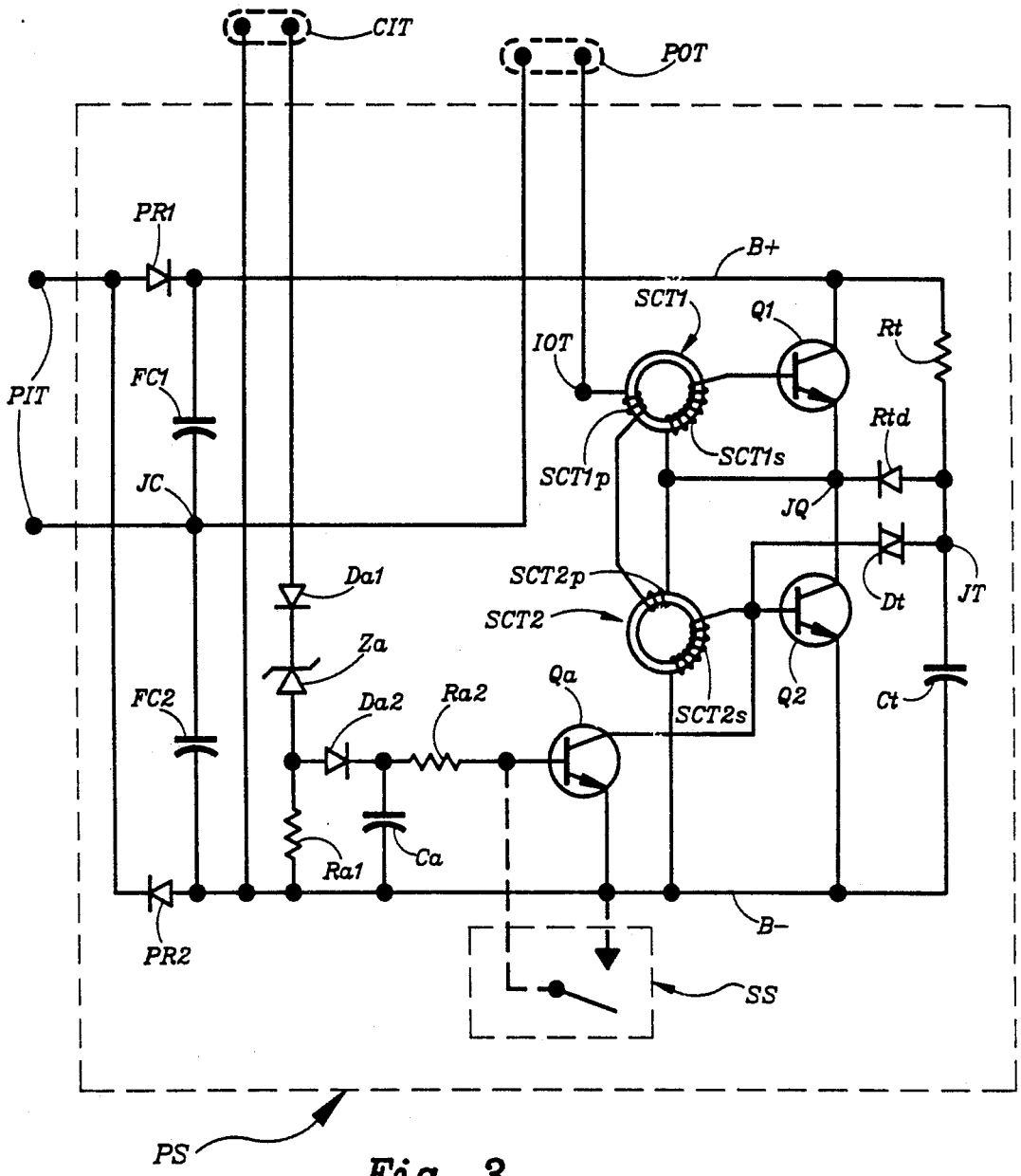
FIG. 3 represents a circuit diagram of the high-frequency power supply.

FIG. 3 represents a circuit diagram of power supply PS with a pair of power input terminals PIT, a pair of power output terminals POT, and a pair of control input terminals CIT.

The anode of a first power rectifier PR1 is connected with one of power input terminals PIT, as well as with the cathode of a second power rectifier PR2. The other one of power input terminals PIT is connected with a junction JC. The cathode of rectifier PR1 is connected with a B+ bus; and the anode of rectifier PR2 is connected with a B− bus.

A first filter capacitor FC1 is connected between the B+ bus and junction JC, and a second filter capacitor FC2 is connected between junction JC and the B− bus.

Junction JC is connected with one of power output terminals POT; while the other one of power output terminals POT is connected with an inverter output terminal IOT.

A first transistor Q1 is connected with its collector to the B+ bus and with its emitter to the collector of a second transistor Q2—with the emitter of Q2 being connected with the B− bus.

A first saturable current transformer SCT1 has a secondary winding SCT1s connected between the base and emitter of transistor Q1; and a second saturable current transformer SCT2 has a secondary winding SCT2s connected between the base and emitter of transistor Q2.

Transformers SCT1 and SCT2 each has a primary winding—SCT1p and SCT2p, respectively; which primary windings are connected in series between inverter output terminal IOT and a junction JQ.

A trigger resistor Rt is connected between the B+ bus and a trigger junction JT, and a trigger capacitor Ct is connected between junction JT and the B− bus. A trigger Diac Dt is connected between junction JT and the base of transistor Q2. A trigger disable rectifier Rtd is connected with its anode to junction JT and with its cathode to junction JQ.

An auxiliary transistor Qa is connected with its collector to the base of transistor Q2 and with its emitter with the B− bus. An optional shorting switch SS (shown in phantom) is connected across the base-emitter junction of transistor Qa.

One of control input terminals CIT is connected with the B− bus; and the other one of control input terminals CIT is connected with the anode of a first auxiliary diode Da1, while the cathode of Da1 is connected with the cathode of an auxiliary Zener diode Za. The anode of Za is connected with the anode of a second auxiliary diode Da2. A first auxiliary resistor Ra1 is connected between the anode of Zener diode Za and the B− bus; and a second auxiliary resistor Ra2 is connected between the cathode of diode Da2 and the base of transistor Qa. An auxiliary capacitor Ca is connected between the cathode of diode Da2 and the B− bus.

Details of Operation

The operation of the circuit of FIG. 1 may be explained as follows.

In FIG. 1, the source S represents an ordinary 120 Volt/60 Hz electric utility power line, the voltage from which is applied directly to the input terminals BIT1-/BIT2 of the ballast.

Capacitor PFCC is principally used for power factor correction during normal operation of the ballast. However, in combination with auxiliary inductor AI, it is also used for establishing a relatively low-magnitude 60 Hz AC voltage at ballast output terminal BOT2; which low-magnitude voltage is mainly productive of providing an increased-magnitude operating voltage for the fluorescent lamp. In this connection, it is noted that the magnitude of the current flowing through the series-combination of PFCC and AI is principally established by the reactance of PFCC, and that the magnitude of the voltage established across AI is principally determined by the magnitude of this capacitive current in combination with the magnitude of the inductive reactance of AI.

In particular, in the preferred embodiment—for operation on a 120 Volt/60 Hz power line and with a more-or-less ordinary F40/T12 four foot fluorescent lamp connected between ballast output terminals BOT1-/BOT1—the magnitude of the relatively low-magnitude voltage established across AI is about 30 Volt. Considering terminal BIT2 as the reference, this means that a 30 Volt/60 Hz will be provided at terminal BOT-2—with the phasing of this 30 Volt/60 Hz voltage being opposite to that of the 120 Volt/60 Hz voltage provided at terminal BIT1. for the ballasting function of the fluorescent lamp—i.e., the magnitude of the open circuit voltage provided across the ballast output terminals BOT1/BOT2—is about 150 Volt.

This voltage magnitude, while adequate to properly operate the fluorescent lamp once it has ignited, is inadequate to permit proper rapid-starting of the lamp.

The purpose of power supply PS is that of providing low-voltage cathode heating power to the lamp's cathodes, as well as that of providing a relatively high-frequency (i.e., about 30 kHz) high-magnitude (i.e., about 250 Volt RMS) ignition voltage across the lamp. After the cathodes have become incandescent, the magnitude of this ignition voltage is adequate to cause the lamp to ignite in a rapid-start manner. And, once the lamp has ignited, additional lamp current will be provided directly from the 120 Volt/60 Hz power line by way of main inductor MI and through the combination of capacitor PFCC and inductor AI.

Once the lamp has ignited and lamp current starts flowing through main inductor MI, a control voltage will be produced across control winding CW. This control voltage is connected to control input terminals CIT of power supply PS, and results in the disabling of the power supply. With the power supply disabled, the output from power output terminals POT disappears.

Thus, after the lamp has ignited, the low-voltage cathode heating power is removed, as is also the high-frequency ignition voltage.

The value of ignition capacitor IC is such as to allow a modest amount (i.e., about 50 milli-Ampere) of high-frequency current to flow in response to the 250 Volt/30 kHz ignition voltage. However, its value is far too low to have any substantive effect at 60 Hz voltages.

As is to be understood from FIG. 3, power supply PS is a more-or-less conventional inverter-type frequency converter and provides a high-frequency (i.e., about 30 kz) squarewave voltage output across the POT terminals of about 40 Volt RMS magnitude; which 40 Volt/30 kHz voltage is applied to the primary winding of power transformer PT, thereby to provide at the transformer's secondary windings the 250 Volt/30 kHz ignition voltage as well as a 3.6 Volt/30 kHz voltage for each cathode.

After the lamp of FIG. 1 has ignited, the current flowing through main inductor MI provides for a 60 Hz control voltage from control winding CW to be applied across control input terminals CIT. Within the power supply, this control signal is rectified by diode Da1 and subjected to a threshold device in the form of Zener diode Za.

As long as full lamp current flow through main inductor MI, the magnitude of this control signal is large enough to overcome the threshold voltage provided by Zener diode Za and to charge capacitor Ca to a voltage high enough to cause enough current to flow into the base of transistor Qa so that this transistor will place an effective short circuit across the base-emitter junction of transistor Q2, thereby preventing the inverter from oscillating.

The capacitance value of capacitor Ca is sufficiently large to provide effective ripple filtering of the 60 Hz single-wave rectified voltage provided from the control voltage presented at control input terminals CIT.

The purpose of resistor Ra1 is that of negating the effect for any small leakage current that might be flowing through the Zener diode below its proper Zener voltage.

The purpose of resistor Ra2 is that of providing a smoothing of the current provided to the base of transistor Qa from capacitor Ca.

Otherwise, the inverter operates in manner well known from prior art, as for instance described in connection with U.S. Pat. Nos. 4,184,128 and 4,507,698 issued to Nilssen.

The operation of the circuit of FIG. 2 is basically the same as that of FIG. 1, except that a common power factor correction capacitor PFCC' and a common auxiliary inductor AI' is used for operation of two fluorescent lamps. Moreover, a common high frequency power supply PS' is used for providing low voltage cathode heating for all four lamp cathodes as well as for providing ignition voltages for both lamps.

After both lamps have ignited, the disablement of the power supply is now accomplished by providing a net control voltage to control input terminals CIT' that is the sum of the voltage from control winding CWa and the voltage from control winding CWb. The threshold device included in the high frequency power supply (element Za of FIG. 3) is so chosen that the presence of but one of the outputs from the two control windings does not provide for adequate magnitude of the net control voltage to cause disablement of the inverter, whereas the presence of both outputs does provide adequate magnitude to cause such disablement.

Additional Comments

1. In FIG. 1, power supply PS could be eliminated and the fluorescent lamp could be started in the conventional pre-heat manner—i.e., by using a conventional fluorescent lamp starter, which would provide an inductive "kick" for igniting the lamp—but that form of lamp starting has significant drawbacks in respect to reliability and consistency of lamp ignition as well as in respect to resulting lamp durability.)

2. The ballast circuit of FIG. 1 is shown for use with a 120 Volt/60 Hz power line. However, the basic concept is also useful with a 277 Volt/60 Hz power line; in which case two F40/T12 4' fluorescent lamps could be used in series configuration.

3. If it is not important to save power by switching off the supply of cathode heating power after lamp ignition, and/or if radio frequency interference is not a problem, it is perfectly permissible to leave the high-frequency power supply running all the time, thereby permitting simplification of the circuitry of FIG. 3.

4. In fact, as shown in phantom in FIG. 3, a shorting switch SS may be connected across the base-emitter junction of transistor Qa, thereby providing for the option of leaving the high-frequency power supply running continuously. Doing so would more readily permit dimming of the fluorescent lamp. Besides, it would provide for a somewhat longer lamp life.

5. There is no basic necessity for powering the high-frequency power supply from the voltage developed across the auxiliary inductor. Rather, in many situations it might be more desirable to power it directly from the power line.

6. Under a ground-fault condition, the lamp current resulting from the high-frequency ignition voltage should be low enough to be acceptable under the specifications of Underwriters Laboratories as being safe from serious electric shock hazard. At a frequency of 30 kHz, this acceptable lamp current is on the order of 30 milli-Ampere; which is the approximate current magnitude resulting from the circuit arrangement of FIG. 1 if a person in contact with ground were to touch the lamp terminals at one end of the lamp while having the terminals of the other end make contact with terminal BOT1.

7. Power transformer PT of the FIG. 1 circuit is shown as having significant magnetic flux leakage between its primary winding and its secondary winding, thereby providing for the proper degree of inductive limitation on the magnitude of the current provided for lamp ignition. It is noted, however, that it is not necessary to provide for such current limitation in respect to the cathode heating power.

8. In the arrangement of FIG. 2 the magnitude-limitation of the ignition current supplied to the two lamps is accomplished, not by transformer (inductive) leakage reactance, but by the reactance of the two ignition capacitors. However, to avoid the relatively undesirable waveform resulting from feeding a high frequency squarewave voltage to a fluorescent lamp by way of a capacitor, it is preferred to have a high frequency sinusoidal voltage output from the power supply PS'.

To make an inverter-type power supply capable of providing sinusoidal high frequency voltage is well known.

9. The fluorescent lamp of FIG. 1 is ignited in a rapid-start manner, which is defined by: i) having the cathodes hot during lamp ignition, ii) providing pre-ionization by way of a starting aid electrode instead of by ionizing the gas in the region near the cathodes by overdriving the cathodes during the starting procedure (which is what is done in the so-called pre-heat starting), and iii) not providing any higher starting voltage than is necessary to ignite the lamp, thereby avoiding instant-start ignition, which is highly detrimental to cathodes not specifically designed for instant-start operation.

10. The magnitude of the post-ignition full-power operating voltage across an F40/T12 four foot fluorescent lamp is about 100 Volt; which under normal circumstances requires a driving source of approximately 150 Volt magnitude for providing proper lamp operation. Lamps having not more than about 80 Volt operating voltage can be properly be powered directly from the 120 Volt/60 Hz power line—without the need for using an auxiliary inductor, such as AI, to provide a voltage boost.

11. The amount of current provided by power supply PS should be adequate to power the lamp at a relatively low level, but need not be able to power the lamp at its full power level.

12. By providing the ignition voltage on a continuous basis, the magnitude of the voltage of the driving source can be reduced without impairing full-power lamp operation. Thus, by leaving shorting switch SS in its closed position, an F40/T12 four foot fluorescent lamp may be properly powered directly from the 120 Volt/60 Hz power line, thereby permitting the elimination of auxiliary inductor AI.

13. It is believed that the present invention and its several attendant features and advantages will be understood from the preceeding description. However, without departing from the spirit of the invention, changes may be made in its form and in the construction and interrelationships of its component parts, the form herein presented merely representing the presently preferred embodiment.

I claim:

1. An arrangement characterized by comprising:

inductor means connected with an ordinary electric utility power line and operative to provide a manifestly current-limited AC voltage at a pair of output terminals; the frequency of the AC voltage being substantially equal to the frequency of the voltage normally present on said power line;

gas discharge lamp connected with these output terminals and operative, but only after having been ignited, to be properly powered by the current-limited AC voltage provided therefrom, the lamp having thermionic cathodes;

cathode power supply means connected in circuit with the power line and operative to provide low-voltage heating power for the thermionic cathodes; and ignition power supply means connected in circuit with the power line and operative to provide an ignition voltage across the lamp, this ignition voltage being: i) of frequency substantially higher than that of the AC voltage, ii) capable, but only after the cathodes have become hot, of causing lamp ignition, and iii) provided independently of any current flowing through the inductor means;

thereby causing the lamp to ignite by way of the ignition voltage and, after having been ignited, to be properly powered from the AC voltage.

2. The arrangement of claim 1 wherein the ignition voltage is removed after the lamp has ignited.

3. The arrangement of claim 1 wherein the cathode heating power is removed after the lamp has ignited.

4. The arrangement of claim 1 wherein lamp ignition is accomplished in rapid-start manner.

5. The arrangement of claim 1 wherein the cathode power supply means is at least partly combined with the ignition power supply means, thereby having a number of components in common.

6. The arrangement of claim 1 wherein the magnitude of the AC voltage before lamp ignition is about fifty percent larger than it is after lamp ignition.

7. The arrangement of claim 1 wherein the magnitude of the ignition voltage before lamp ignition is about two to three times larger than it is after lamp ignition.

8. In an arrangement characterized by:

a) having inductor means connected in circuit with an ordinary electric utility power line and operative to provide a manifestly current-limited AC voltage at a pair of output terminals, the AC voltage being of relatively low frequency; and b) having a gas discharge lamp connected with these output terminals and operative, but only after having been ignited, to be fully powered by the current-limited AC voltage provided therefrom, the lamp having thermionic cathodes;

the improvement comprising:

auxiliary power supply connected in circuit with the power line and operative to provide low-voltage cathode heating power for the cathodes and a high-frequency ignition voltage across the lamp, this ignition voltage being: i) of relatively high frequency, ii) productive of causing lamp ignition, but only after the cathodes have become hot, iii) inoperative to provide enough current to fully power the lamp, and iv) provided independently of any current flowing through the inductor means;

thereby causing the lamp to ignite by way of the high frequency ignition voltage and, after having been ignited, to be fully powered from the low frequency AC voltage.

9. The improvement of claim 8 wherein the ignition voltage is removed after the lamp has ignited.

10. The improvement of claim 8 wherein the cathode heating power is removed after the lamp has ignited.

11. An arrangement comprising:

an ordinary electric utility power line operative to provide a substantially non-current-limited AC voltage between a live and a reference power line terminal;

a capacitor means connected between the live power line terminal and an auxiliary junction;

an auxiliary inductor means connected between the auxiliary junction and the reference power line terminal, thereby causing an auxiliary voltage to be present at this auxiliary junction, the phasing of this auxiliary voltage being substantially opposite to that of the voltage present at the live power line terminal; and a gas discharge lamp connected at a cathode junction with a main current-limiting inductor to form a series-combination, this series-combination being connected between the live power line terminal and the auxiliary junction;

such that a current-limited AC voltage is provided across this series-combination, where the magnitude of this current-limited AC voltage is larger than that of the non-current-limited AC voltage, thereby permitting proper operation of the gas discharge lamp even though the magnitude of the voltage required for its proper operation may be higher than that of the voltage available directly from the power line.

12. The arrangement of claim 11 and lamp ignition means connected in circuit between the power line and the cathode junction and operative to cause the lamp to ignite even though the magnitude of the current-limited AC voltage may by itself be inadequate to cause lamp ignition.

13. The arrangement of claim 12 wherein: i) the gas discharge lamp means comprises thermionic cathodes, and ii) the ignition means is operative to provide low-voltage heating power for these cathodes.

14. The arrangement of claim 11 wherein, at the fundamental frequency of the voltage on the power line, the net impedance of the series-combination of the capacitor means and the auxiliary inductor means is predominantly capacitive.

15. The arrangement of claim 11 wherein the series-combination of the capacitor means and the auxiliary inductor means is non-resonant at any of the harmonics of the voltage present on the power line.

* * * * *